US007416340B2

(12) United States Patent
Schneider

(10) Patent No.: US 7,416,340 B2
(45) Date of Patent: Aug. 26, 2008

(54) RECLOSABLE PACKAGING HAVING ZIPPER WITH SLIDER END STOPS

(75) Inventor: John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/604,971

(22) Filed: Nov. 27, 2006

(65) Prior Publication Data

US 2007/0092165 A1 Apr. 26, 2007

Related U.S. Application Data

(62) Division of application No. 10/291,883, filed on Nov. 8, 2002, now Pat. No. 7,141,013.

(51) Int. Cl.
*B65D 33/16* (2006.01)

(52) U.S. Cl. ..... 383/64; 24/399; 24/400

(58) Field of Classification Search ..... 383/64; 24/399, 400, 435, 436, 387
See application file for complete search history.

(56) References Cited

U.S. PATENT DOCUMENTS 5,067,208 A * 11/1991 Herrington, Jr. et al. ..... 24/400
5,088,971 A 2/1992 Herrington
5,131,121 A 7/1992 Herrington et al.
5,161,286 A 11/1992 Herrington et al.
5,189,764 A * 3/1993 Herrington et al. ..... 24/384
5,405,478 A 4/1995 Richardson et al.
5,448,807 A 9/1995 Herrington
5,669,715 A 9/1997 Dobreski et al.
5,682,730 A 11/1997 Dobreski
5,833,791 A 11/1998 Bryniarski et al.
5,836,056 A 11/1998 Porchia et al.
5,924,173 A * 7/1999 Dobreski et al. ..... 24/400
5,947,603 A 9/1999 Tilman
6,286,999 B1 * 9/2001 Cappel et al. ..... 383/5
6,357,914 B1 3/2002 Kinigakis et al.
6,385,818 B1 5/2002 Savicki, Sr.
6,442,804 B2 * 9/2002 Turvey et al. ..... 24/399
6,846,107 B2 * 1/2005 Sweeney et al. ..... 383/64
7,213,303 B1 * 5/2007 Savicki ..... 24/387
2003/0014848 A1 * 1/2003 LaRue et al. ..... 24/387

* cited by examiner

*Primary Examiner*—Nathan J Newhouse
*Assistant Examiner*—Jack H Morgan, Jr.
(74) *Attorney, Agent, or Firm*—Ostrager Chong Flaherty & Broitman P.C.

(57) ABSTRACT

A reclosable package comprising a receptacle and an assembly, the assembly comprising a plastic zipper joined to or integrally formed with the receptacle and a slider mounted to the zipper. The zipper comprises first and second interlockable profiled closure members, and a slider end stop projecting outward from a side of the first closure member for a distance sufficient to obstruct further travel of the slider in a closing direction. The slider end stop comprises a body of plastic material joined to the first closure member, the body being disposed near one end of the zipper and entirely within an elevational range bounded by top and bottom edges of the first closure member.

11 Claims, 3 Drawing Sheets

RECLOSABLE PACKAGING HAVING ZIPPER WITH SLIDER END STOPS

RELATED PATENT APPLICATION

This application is a divisional of and claims priority from U.S. patent application Ser. No. 10/291,883 filed on Nov. 8, 2002, which issued on Nov. 28, 2006 as U.S. Pat. No. 7,141,013.

BACKGROUND OF THE INVENTION

This invention generally relates to methods and apparatus for manufacturing slider-operated flexible zippers for use in reclosable pouches, bags or other packages of the type in which material, such as foodstuff and detergent, are stored.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies often include a plastic zipper and a slider. Typically, the plastic zippers include a pair of interlockable profiled members that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other.

One of the important features of zipper assemblies operated by sliders without separating fingers is the end stop, which prevents the clipped-on slider from falling off when the slider reaches the end of the fastener. A slider end stop is provided on each end of the zipper. End stops have taken on various configurations, such as, for example, riveted end clamps such as those described in U.S. Pat. Nos. 5,067,208 and 5,161,286; transverse end stops made from molten material of the fastener strips, as described in U.S. Pat. No. 5,088,971; tubular end stops, as described in U.S. Pat. No. 5,405,478; a window structure combined with sealed zipper ends, as described in U.S. Pat. No. 5,442,837; plastic end clips fused to the zipper, as described in U.S. Pat. No. 5,448,807; posts with enlarged heads that pass through the ends of the zipper profiles, as described in U.S. Pat. No. 5,924,173; and plastic ribbon, monofilament or clip-shaped segments that conform to the outer shape of and are fused to the zipper profile, as described in U.S. Pat. No. 5,833,791.

A slider end stop must be designed to withstand the forces applied by a consumer during normal use. More specifically, as the consumer pulls the slider to either end of the zipper, the end stop should not bend, fold, collapse or otherwise lose its ability to stop the slider when the slider is pressed against the end stop by the consumer. Preferably a slider end stop has relatively high slider pull-off resistance.

There is a need for improvements in the manufacture and construction of slider end stops for slider-operated zippers. In particular, there is a need for an improved, yet economical method of making a slider end stop having high slider pull-off resistance.

BRIEF DESCRIPTION OF THE INVENTION

The invention is directed to methods of making slider end stops on zippers for reclosable packaging. The invention is further directed to various slider-zipper assemblies in which slider end stops are joined to a profiled closure member of the zipper and to reclosable packages incorporating such assemblies.

One aspect of the invention is a method of manufacture comprising the following steps: extruding a zipper part comprising a plastic closure member that has an interlockable profile and that has a side opposite to the profile; and joining a piece of plastic material to the side of the closure member, the piece being disposed entirely within an elevational range bounded by top and bottom edges of the closure member.

Another aspect of the invention is a method of making slider end stops on an end section of a plastic zipper, comprising the following steps: interlocking a pair of profiled closure members together along their length to form a zipper; cutting the zipper to form a generally transverse end face; making an elongated piece of plastic material having first and second bodies connected by a foldable strap in a central section; wrapping the elongated piece around the cut end with the strap confronting the generally transverse end face, and with the first and second bodies being disposed adjacent and exterior to opposing sides of the zipper; and joining the first and second bodies of plastic material to the respective sides of the zipper.

A further aspect of the invention is an assembly comprising a plastic zipper and a slider mounted to the zipper, wherein the zipper comprises first and second interlockable profiled closure members that are joined at first and second ends of the zipper, and a slider end stop projecting outward from a side of the first closure member for a distance sufficient to obstruct further travel of the slider in one, wherein the slider end stop comprises a body of plastic material joined to the first closure member, the body being disposed near the first end of the zipper and entirely within an elevational range bounded by top and bottom edges of the first closure member.

Another aspect of the invention is an assembly comprising a plastic zipper and a slider mounted to the zipper, wherein the zipper comprises first and second interlockable profiled closure members that are joined at first and second ends of the zipper, and a slider end stop projecting outward from a side of the first closure member for a distance sufficient to obstruct further travel in one direction by the slider, wherein the slider end stop is disposed near the first end of the zipper and entirely within an elevational range bounded by top and bottom edges of the first closure member, and the slider has a notch that receives a portion of the slider end stop before the slider end stop stops further travel by the slider, the notch being formed in part by a surface that is situated under a portion of the slider end stop when the slider abuts the slider end stop.

Yet another aspect of the invention is an assembly comprising a plastic zipper and a slider mounted to the zipper, wherein the zipper comprises first and second interlockable profiled closure members, a slider end stop projecting outward from a side of the first closure member for a distance sufficient to obstruct further travel in one direction by the slider, and a fastener that fastens the slider end stop to one end of the zipper. The slider end stop comprises a body of plastic material disposed entirely within an elevational range bounded by top and bottom edges of the first closure member.

Another aspect of the invention is an assembly comprising a plastic zipper and a slider mounted to the zipper, wherein the zipper comprises first and second interlockable profiled closure members having respective opposing ends, and an elongated piece of plastic material wrapped around one end of the zipper. The elongated piece comprises first and second bodies connected by a strap. The first body is joined to an exterior of the first closure member and the second body is joined to an exterior of the second closure member, while the strap confronts an endface of the zipper. The first and second bodies obstruct further travel of the slider toward the end of the zipper.

Yet another aspect of the invention is an assembly comprising a plastic zipper and a slider mounted to the zipper, wherein the zipper comprises first and second interlockable profiled closure members, the first closure member comprising a hole, and a slider end stop comprising a toothed shaft that penetrates the hole in the first closure member and a head that projects outward from a side of the first closure member for a distance sufficient to obstruct further travel in one direction by the slider.

Other aspects of the invention include reclosable packages comprising a receptacle and a slider-zipper assembly of any one of the types described in the preceding five paragraphs, wherein the zipper is joined to or integrally formed with the receptacle.

Other aspects of the invention are disclosed and claimed below.

DETAILED DESCRIPTION OF THE INVENTION

Figure 1:
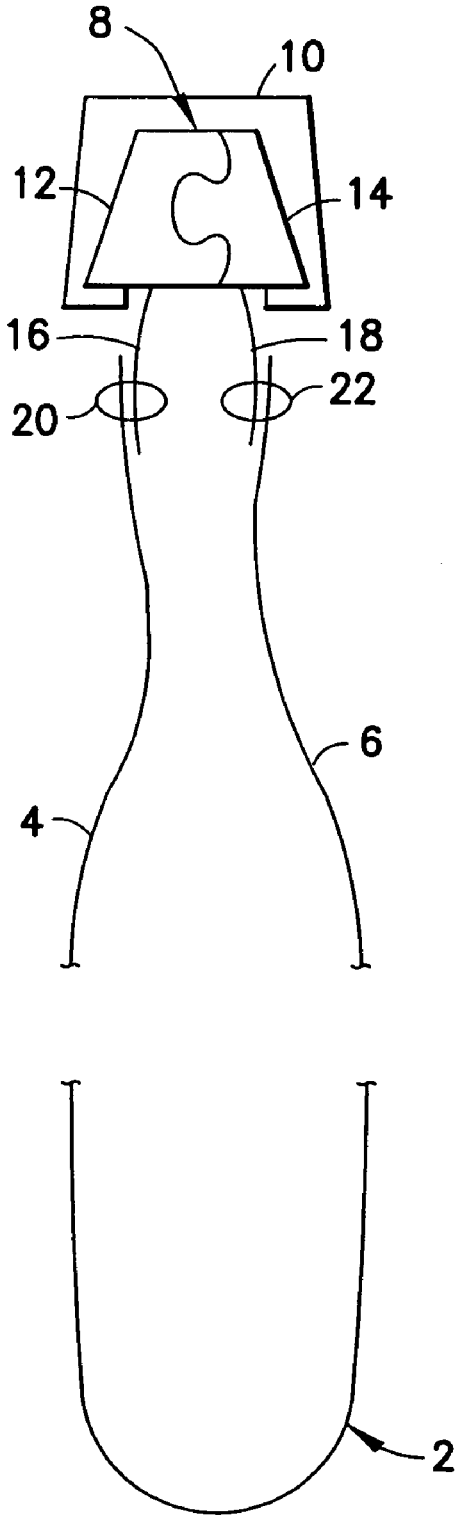
FIG. 1 PRIOR ART
FIG. 1 is a drawing showing a sectional view of one type of reclosable bag having a slider-operated zipper.

Reference will now be made to the drawings, in which similar elements in different drawings bear the same reference numerals. For the purpose of illustration, some embodiments of the invention will be described with reference to a reclosable package of the type depicted in FIG. 1. However, application of the slider end stop formation techniques of the present invention is not limited to reclosable bags of the type shown in FIG. 1. For example, the reclosable bag may incorporate other types of slider-zipper assemblies. Also the zipper can be integrally formed with the bag making film, instead of having flanges that are joined to the bag making film, as is depicted in FIG. 1. Further, the reclosable package may be provided with a header that encloses the slider-zipper assembly and acts as a tamper-evident feature. Alternatively, the bag could be formed with side gussets, with or without a bottom panel.

FIG. 1 is a general depiction of one type of conventional reclosable bag 2 incorporating a zipper 8 and a slider 10 mounted to the zipper. The bag 2 comprises a front wall 4 and a rear wall 6 integrally connected at a fold line situated at the bottom of the bag. Although not shown in FIG. 1, the walls 4 and 6 are also joined at the sides of the package, at least from the bottom to the zipper profile by respective side seals. Alternatively, the walls could be separate panels that are sealed together at their bottom edges as well as at their side edges. The bag walls 4 and 6 are formed of a suitable plastic film material for the product to be contained within the package. For example, the film may be a laminate or coextrusion comprising a gas barrier layer and/or a low-melting-point sealant layer.

The zipper 8 comprises a closure member 12 having a female profile and a closure member 14 having a male profile that interlocks with the female profile in the zipper section being closed as the slider travels in the closing direction. The zipper 8 further comprises a zipper flange 16 having one end connected or joined to closure member 12 and a zipper flange 18 having one end connected or joined to closure member 14.

As seen in FIG. 1, zipper flange 16 is secured to the bag front wall 4 by a permanent seal 20 proximal to the top of the bag, while zipper flange 18 is secured to the bag rear wall 6 by a permanent seal 22. The permanent seals 20 and 22 are indicated by ovals. It should be appreciated that each permanent seal is a band of joined, e.g., fused, material that extends from one side seal of the bag to the other side seal, thereby securing the zipper to the bag along the width of the bag. The permanent seals 20 and 22 are generally parallel to each other and may be formed by any conventional method, such as conduction heat sealing.

It is known to apply a slider-operated zipper to a web of bag making film when advancement of the film toward a form-fill-seal (FFS) machine is temporarily halted. In one known system, a zipper tape is unwound from a spool and advanced to a device for forming slider end stops in accordance with one of the techniques disclosed hereinafter. The zipper tape is then advanced to a slider insertion device, which inserts a respective slider on each segment of zipper corresponding to the zipper length in the reclosable package. Then the zipper tape with inserted sliders is advanced toward the zipper tape application station, where one zipper length or segment will be severed from the remainder of the zipper tape and joined to bag making film that has been unwound from a roll and is being fed under tension to the FFS machine.

Figure 2:
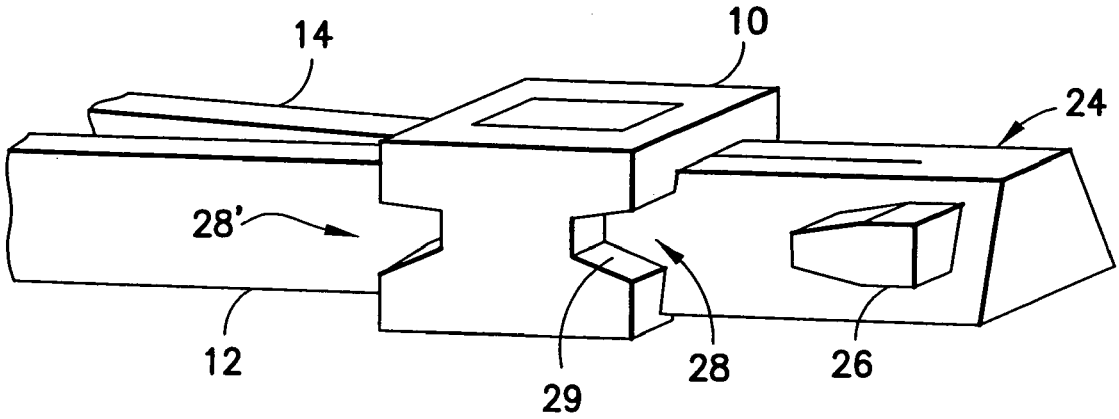
FIG. 2 is a drawing showing an isometric view of a portion of a zipper with slider mounted thereon in accordance with one embodiment of the invention.

FIG. 2 depicts one end of a slider-zipper assembly in accordance with one embodiment of the invention. The profiled closure members 12 and 14 are joined to each other at opposing ends of the zipper. One of the joined ends 24 is shown in FIG. 2. The slider-zipper assembly may be of the type wherein the profiled closure members contact each other at a fulcrum point, the section of the zipper inside the slider being acted on by the slider in a manner dependent upon the direction in which the slider is moving. If the slider is moving in the opening direction, then the engaged sections of the closure members that enter the slider are rotated about the fulcrum point in a direction that causes the engaged profiles to disengage from each other, thereby opening those zipper sections. Conversely, if the slider is moving in the closing direction, then the disengaged sections of the closure members that enter the slider are rotated about the fulcrum point in a direction that causes the disengaged profiles to engage each other, thereby closing those zipper sections. However, this is merely one example of one type of slider-zipper assembly for which the various aspects of the invention can be employed.

Still referring to FIG. 2, the zipper is provided with at least one slider end stop 26 at each end of the zipper (the slider end stop at the other end is not shown). Optionally, the zipper may be provided with a respective pair of slider end stops at each end, the end stops of each pair having the same size and shape and having mirrored positions on opposing sides of the zipper. The slider end stop 26 shown in FIG. 2 is joined to the side of the profiled closure member 12 that is disposed opposite to the zipper profile of that closure member, i.e., the side of closure member 12 on the exterior of the zipper. The slider end stop 26 projects outward from the side of closure member 12 for a distance sufficient to obstruct further travel of the slider 10 in the opening direction. The slider end stop 26 comprises a body of plastic material joined to the closure member 12. The body 26 is disposed near the joined end 24 of the zipper and entirely within an elevational range bounded by the top and bottom edges of the closure member 12.

In accordance with a further aspect of the invention, the slider 10 has a notch 28 that receives a portion of slider end stop 26 before the latter stops further travel of the slider. The portion of the end stop received in notch 28 is tapered. The notch 28 is formed in part by an oblique surface 29 that lodges under the tapered portion of slider end stop 26 when the slider is stopped by the latter. The latching of surface 29 under the tapered end of the slider end stop prevents the leading end of the slider from being lifted or tilted upward and off the zipper when the slider is in the fully open parked position. Although not necessary to practice of the invention, the notch 28 may have a profile that matches the profile of the tapered end of the slider end stop.

Although not visible in FIG. 2, the zipper further comprises a second slider end stop projecting outward from the side of one of the closure members 12 or 14 for a distance sufficient to obstruct further travel of the slider 10 in the closing direction. The second slider end stop preferably has the same configuration and disposition as for the slider end stop 26. Likewise the slider 10 is provided with another notch 28' for latching under the second slider end stop when the slider is in the fully closed park position.

In accordance with one embodiment, the slider end stops are joined to the zipper by applying a layer of adhesive material between confronting surfaces of the end stop 26 and the closure member 12. In accordance with another embodiment, the plastic material in a portion of the closure member 12 is fused to a confronting portion or surface of the slider end stop. In accordance with yet another embodiment, the end stop could be formed on the closure member by injection molding, with or without preparation of the surface or shaping of the profile of the closure member in the area where the end stop will be located.

Figure 3:
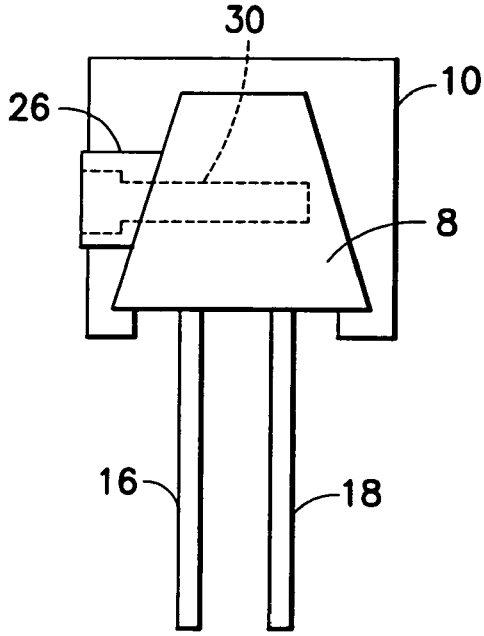
FIG. 3 is a drawing showing an end view of a zipper having a riveted end stop in accordance with another embodiment of the invention.
Figure 4:
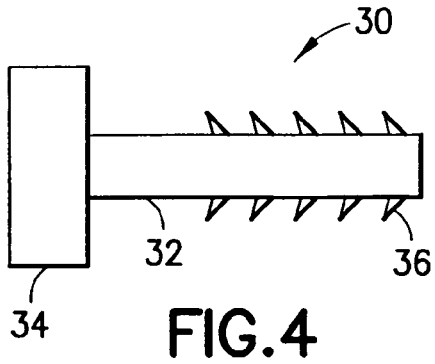
FIG. 4 is a drawing showing a side view of a rivet with teeth for use in the embodiment depicted in FIG. 3.

In accordance with yet another embodiment, the slider end stop 26 is fastened to the zipper by means of a rivet 30, as shown in FIG. 3. In the illustrated example, the rivet 30 penetrates a throughhole in the end stop piece 26 and a hole formed in the joined end section of the zipper 8. The hole in the joined end of the zipper is generally transverse to the longitudinal axis of the zipper. The structure of the rivet is shown in FIG. 4. The rivet 30 comprises a shaft 32 and a head 34. A multiplicity of tooth-like projections 36 on the shaft are shaped to provide a self-locking feature, i.e., the tooth tips will not interfere when the rivet is inserted into the hole but will grip the surrounding plastic material of the zipper when an attempt is made to pull the rivet out of the hole. The throughhole in the end stop piece may be countersunk so that the rivet head will lie flush with or below the surface of the end stop.

In accordance with a variation of the embodiment depicted in FIG. 3, instead of riveting the end stop to a joined end section of the zipper, the ends of the closure members 12 and 14 can be unjoined at the time when the rivet is inserted. In this case the rivet will join the end stop to the zipper and will further join the closure members to each other. The rivet may have the same configuration as is shown in FIG. 4. A hole that is closed at one end must be formed in the closure member furthest from the end stop, with throughholes being formed in the other closure member and the end stop itself. These holes are aligned to form a single passage in which the rivet 30 will be inserted. The teeth on the rivet shaft may be positioned so that both closure members are engaged by respective sets of teeth along respective portions of the shaft. The head of the rivet in conjunction with engagement by the teeth as well as surface friction will fasten the slider end stop and the ends of the closure members together in one step.

Figure 5:
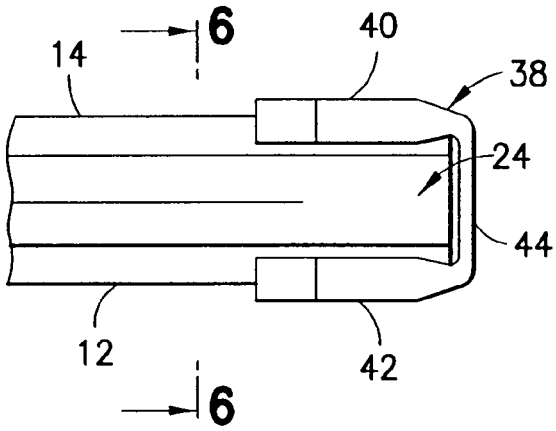
FIG. 5 is a drawing showing a top view of an end portion of a zipper having a wraparound end stop in accordance with yet another embodiment of the invention.
Figure 6:
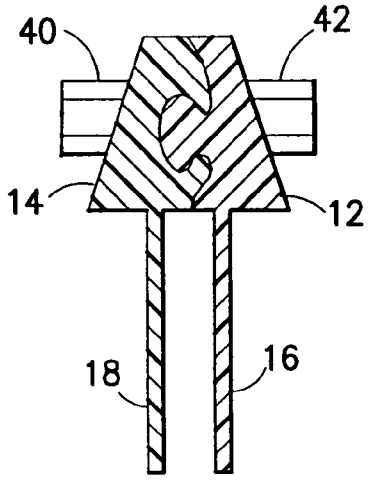
FIG. 6 is a drawing showing a sectional view of the embodiment depicted in FIG. 5, the section being taken along line 6-6 indicated in FIG. 5.

In accordance with yet another embodiment of the invention depicted in FIGS. 5 and 6, an elongated piece 38 of plastic material is wrapped around the joined end 24 of the zipper. The elongated piece 38 comprises a pair of slider end stop bodies 40 and 42 connected by a strap or membrane 44. Each of bodies 40 and 42 may have a shape similar to the shape of the body 26 depicted in FIG. 2, with the difference that these bodies are connected by a continuous strap of membrane made of the same plastic material. As seen in FIG. 6, the end stop body 40 is joined to the side of closure member 14, while the end stop body 42 is joined to the side of closure member 12. The strap 44 is disposed adjacent to and overlapping an endface of the zipper. The end stop bodies can be joined to the closure members by gluing or by applying heat to soften portions of the closure members and pressing the bodies against the respective softened portions, the bodies being fused to the closure members when the softened material has cooled sufficiently. Optionally, the strap 38 can be joined (by gluing or welding) to the endfaces of the zipper closure members. Alternatively, the elongated piece could be formed on the end section of the zipper by injection molding, with or without preparation of the surface or shaping of the profiles of the closure members in the areas where injected molten plastic will contact the zipper.

In addition to the above-described products, the invention is also directed to various methods for manufacturing those products.

In accordance with one method of manufacture, a pair of plastic zipper parts, each comprising a profiled closure member and a connected zipper flange (e.g., having the structure generally depicted in FIG. 1), are extruded and interlocked together. Then a piece of compatible plastic material in the shape of a slider end stop is joined to the side of the closure member of the first zipper part opposite to its interlockable profile. The end stop piece is disposed entirely within an elevational range bounded by the top and bottom edges of the closure member. This process is repeated twice for each zipper segment of one package width. Optionally, end stop pieces can also be joined to the closure member of the second zipper part at identical positions as those for the first zipper part. After sliders are mounted to the zipper tape at spaced intervals therealong (one slider per zipper segment), the resulting slider-zipper assembly can be fed to a zipper application, where one zipper flange is attached to a web of bag making film. The bag making film with bag making film with slider-zipper assemblies attached at spaced intervals can then be fed to a form-fill-seal machine in conventional fashion.

Alternatively, the end stop pieces can be joined to one or both closure members before the zipper parts have been interlocked.

In one embodiment of the aforementioned joining step, the end stop piece is glued to the side of the closure member using quick-cure adhesive. Optionally, the surface of the closure member may be prepared, e.g., roughened or knurled, prior to gluing. Then a layer of adhesive is applied to the prepared surface or to the contacting surface on the end stop piece and the end stop piece is pressed against the prepared surface of the closure member with the layer of adhesive therebetween. The end stop piece is maintained in this state while the adhesive is allowed to cure.

In another embodiment of the foregoing joining step, a portion of the closure member is heated to a softening temperature and optionally shaped, and then the end stop piece is pressed against the softened region of the closure member. The end stop piece is maintained in this state while the softened plastic of the closure member is allowed to cool, thereby fusing the end stop piece to the closure member.

In yet another embodiment of the joining step, a hole (it need not be a throughhole) is formed in the closure member, the axis of the hole being generally transverse to the longitudinal axis of the zipper part. Also, a throughhole is formed in the end stop piece. Thereafter, the end stop piece is positioned so that its throughhole is aligned and in communication with the hole in the closure member. Then a self-locking rivet having a toothed shaft is inserted into the throughhole of the end stop piece and further into the hole in the closure member, thereby fastening, i.e., joining, the end stop piece to the closure member.

In accordance with a further embodiment of the end stop joining step, a portion of the closure member is shaped or its surface is prepared. Then a mold is positioned adjacent to the shaped or otherwise prepared portion of the closure member. Conventional injection molding can then be used to form a slider end stop, the base of which will fuse to the shaped or prepared portion of the closure member. More specifically, compatible plastic material is heated to a liquefied state; the liquefied plastic material is injected into the mold; and then the injected plastic material is cooled under pressure and ejected from the mold, leaving a molded end stop joined to the closure member.

Each of the foregoing slider end stop joining techniques can be performed on one or both profiled closure members after the closure members have been interlocked and after confronting sections of the closure members have been joined to each other at spaced intervals in anticipation of forming joined end sections later when successive zipper segments are cut off the end of the zipper tape. In this case, the end stops are preferably placed at positions that at least partially overlap the joined end section.

In accordance with a further alternative method of manufacture, the slider end stops can be riveted to unjoined sections of interlocked closure members, with the rivets serving to not only join the end stop piece to the zipper, but also join the closure members to each, in anticipation of a subsequent cutting operation that will place the riveted sections at opposing ends of each zipper segment. In accordance with this embodiment of the joining step, a hole (it need not be a throughhole) is formed in the first closure member, the axis of the hole being generally transverse to the longitudinal axis of the zipper part. Also, a throughhole is formed in the second closure member, this throughhole being collinear with the hole in the first closure member. Lastly, a throughhole is made in the end stop piece. Thereafter, the end stop piece is positioned so that its throughhole is aligned and in communication with the throughhole in the second closure member. Then a self-locking rivet having a toothed shaft is inserted into the throughhole of the end stop piece, into the throughhole in the second closure member and further into the hole in the first closure member, thereby fastening, i.e., joining, the end stop piece and the closure members together.

Alternatively, the rivet alone could be used as the stopping mechanism. In this, embodiment the toothed shaft would grip a hole in the zipper end, while the rivet head protruded from the side of the zipper to a height sufficient to block passage of the slider. Optionally, the toothed shaft of the rivet could also serve to fasten the ends of the closure members together.

In accordance with yet another alternative method of manufacture, the slider end stops can be joined to the end of a zipper after cutting. In this embodiment, an elongated piece of plastic material, of the type described with reference to FIGS. 5 and 6, is wrapped around the cut end of a zipper tape or a zipper segment separated from the zipper tape and then joined by adhesion or fusion. This method can be applied to joined or unjoined ends of the zipper closure members. Alternatively, the elongated piece can be formed on the unjoined ends of the zipper closure members by injection molding.

More specifically, the method of joining a wraparound elongated piece comprises the following steps: interlocking a pair of profiled closure members together along their length to form a zipper; cutting the zipper to form a generally transverse endface; making an elongated piece of plastic material having two bodies connected by a foldable strap in a central section; wrapping the elongated piece around the cut end with the strap confronting the generally transverse endface, and with the bodies respectively disposed adjacent and exterior to the opposing sides of the zipper; and joining the bodies of plastic material to the respective sides of the zipper. Optionally, the strap can be joined to the endface of the zipper. The bodies can be glued or fused to the sides of the zipper. Fusing can be accomplished by heating respective exterior portions on the zipper sides to a softening temperature, and then pressing the bodies against the respective softened exterior portions.

As previously mentioned, the invention also encompasses reclosable bags in which bag making film and first and second interlockable profiled closure members are integrally formed, e.g., by extrusion. The bag making film is then folded in a manner that aligns the first and second closure members in opposition to each other. The slider end stops can be formed before or after folding.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The listing of method steps in any annexed claim, in the absence of express limiting language in the claim, is not intended to limit the scope of that claim to mean that the method steps must be performed in the order in which they are listed. For example, the end stops can be joined to the closure members before or after the closure members have been interlocked to form a zipper. As used in the claims, the verb "joined" means fused, bonded, sealed, adhered, fastened, whether by application of heat and/or pressure, application of ultrasonic energy, application of a layer of adhesive material or bonding agent, interposition of an adhesive or bonding strip, insertion of a rivet, or other substantially equivalent means.

The invention claimed is:

1. A reclosable package comprising a receptacle and an assembly, said assembly comprising a plastic zipper joined to or integrally formed with said receptacle and a slider mounted to said zipper, wherein said zipper comprises first and second interlockable profiled closure members, and a first slider end stop projecting outward from a first surface area of a side of said first closure member for a distance sufficient to obstruct further travel of said slider in a first direction, said first surface area being surrounded by a second surface area of said side of said first closure member, wherein said first slider end stop comprises a first body of material joined to said first surface area of said first closure member and not in contact with said second surface area, said first body being disposed near one end of said zipper and entirely within an elevational range bounded by top and bottom edges of said first closure member, and wherein said slider comprises a sidewall having a first notch that starts at one end thereof for receiving a portion of said first body as said slider approaches during movement in said first direction, and wherein when said slider is stopped by said first body received in said first notch, said sidewall has a first portion disposed above said first body and a second portion disposed below said first body, and said first body is not disposed between said sidewall and said zipper.

2. The package as recited in claim 1, wherein said portion of said first body received in said notch of said slider is tapered.

3. The package as recited in claim 1, further comprising a layer of adhesive material between said first body and said first closure member.

4. The package as recited in claim 1, wherein material of said first closure member is fused to said first body at the juncture of said first body and said first closure member.

5. The package as recited in claim 1, further comprising first and second zipper flanges respectively connected to said first and second closure members.

6. The package as recited in claim 1, wherein said zipper further comprises a second slider end stop projecting outward from said side of said first closure member or a side of said second closure member for a distance sufficient to obstruct further travel of said slider in a second direction opposite to said first direction, wherein said second slider end stop comprises a second body of material joined to said first or second closure member, said second body being disposed near said second end of said zipper and entirely within said elevational range, and wherein said sidewall of said slider has a second notch that starts at an other end thereof for receiving a portion of said second body as said slider approaches during movement in said second direction, and wherein when said slider is stopped by said second body received in said second notch, said sidewall has a third portion disposed above said second body and a fourth portion disposed below said second body, and said second body is not disposed between said sidewall and said zipper.

7. The package as recited in claim 6, wherein said zipper further comprises a third slider end stop projecting outward from a side of said second closure member for a distance sufficient to obstruct further travel of said slider in said first direction, wherein said_third slider end stop comprises a third body of material joined to said second closure member, said third body being disposed near said first end of said zipper and entirely within said elevational range, further comprising a strap having one end connected to said first body and another end connected to said third body, said strap being adjacent to and overlapping an endface at said first end of said zipper.

8. A reclosable package comprising a receptacle and an assembly, said assembly comprising a plastic zipper joined to or integrally formed with said receptacle and a slider mounted to said zipper, wherein said zipper comprises first and second interlockable profiled closure members, a slider end stop projecting outward from a side of said first closure member for a distance sufficient to obstruct further travel in one direction by said slider, and a fastener that fastens said slider end stop to one end of said zipper, wherein said slider end stop comprises a body of material disposed entirely within an elevational range bounded by top and bottom edges of said first closure member, wherein said second closure member comprises a hole, said first closure member comprises a throughhole aligned with said hole and in communication therewith and said body comprises a throughhole aligned with said throughhole in said first closure member, and said fastener comprises a rivet that penetrates said hole and said throughholes and that engages at least said second closure member.

9. The package as recited in claim 8, wherein said rivet comprises teeth that engage said second closure member.

10. The package as recited in claim 8, wherein said rivet also engages said first closure member.

11. The package as recited in claim 8, wherein said rivet comprises a toothed shaft that penetrates said hole in said first closure member and has one end engaged with said second closure member.

* * * * *